United States Patent [19]

Nuchman et al.

[11] 4,074,469

[45] Feb. 21, 1978

[54] APPARATUS FOR MANUFACTURING LENSES

[76] Inventors: Benjamin Nuchman, 820 Birchwood Drive, Westbury, N.Y. 11590; Sang Y. Whang, 8445 SW. 148th Drive, Miami, Fla. 33143

[21] Appl. No.: 590,648

[22] Filed: June 26, 1975

Related U.S. Application Data

[62] Division of Ser. No. 440,882, Feb. 8, 1974, abandoned.

[51] Int. Cl.[2] ..... B24B 41/06

[52] U.S. Cl. ..... 51/217 L

[58] Field of Search ..... 51/216 L, 217 L, 277

[56] References Cited

U.S. PATENT DOCUMENTS

| | | | |
|---|---|---|---|
| 3,069,818 | 12/1962 | Atols | 51/277 |
| 3,079,736 | 3/1963 | Kratt | 51/217 L |
| 3,079,737 | 3/1963 | Kratt | 51/217 L |
| 3,153,960 | 10/1964 | Allport | 51/217 L |
| 3,589,079 | 6/1971 | Beasley | 51/277 |

*Primary Examiner*—Harold D. Whitehead

*Attorney, Agent, or Firm*—Blum, Moscovitz, Friedman & Kaplan

[57] ABSTRACT

A device is provided for forming aspheric surfaces in an optical lens by distorting the lens blank in a predetermined manner and forming spherical surfaces in the distorted lens. One or both surfaces of the lens may be formed with an aspheric surface. The resultant lens may include a cylindrical correction also produced by distortion or may include substantially continuous bifocal lens. The lens is particularly adapted for application as a contact lens.

10 Claims, 27 Drawing Figures

APPARATUS FOR MANUFACTURING LENSES

This is a division, of application Ser. No. 440,882, filed Feb. 8, 1974 and now abandoned.

BACKGROUND OF THE INVENTION

Generally speaking, this invention relates to the manufacture of optical lenses for application, among others, as eye glasses and contact lenses.

Lenses have generally been formed with spherical surfaces due to the convenience of grinding. An aspheric surface would be difficult and expensive to produce by conventional methods such as a numerically controlled lathe. However, conventional lenses provide several disadvantages. In the case of contact lenses, the cornea is aspheric, yet most contact lenses are formed with a spherical inner surface producing irregular tear layers and localized bearing areas. With the development of a device for extending the range of a keratometer to permit measurement of the curvature of a cornea at different radial positions, as taught in our U.S. Pat. No. 3,609,017, accurate knowledge of the shape of the cornea is available, permitting the design of contact lenses having an aspheric inner surface were a convenient method of manufacture available. Further, it has proved difficult to provide cylindrical corrections for dealing with astigmatism and a bifocal capability in contact lenses.

The foregoing deficiencies in the prior art are avoided by the methods and apparatus in accordance with the invention.

SUMMARY OF THE INVENTION

Generally speaking, in accordance with the invention, a apparatus for forming lenses by the distortion of lens blanks and the forming of spherical surfaces in the distorted lens blank is taught. In a first device for forming an aspheric surface in a lens blank, said lens is held at the periphery and distorting pressure is applied along the axis of the blank at a first side thereof. A spherical surface is formed on a second side of said blank opposite to said first side, which defines an aspheric surface when said distortion is released. In a second embodiment a lens blank is distorted as recited above and the lens blank is fixed in the distorted position by grasping the blank at said second side. A spherical surface is then formed in said first side to define an aspheric surface when said blank is released.

In a third embodiment, which can be used in conjunction with other embodiments, a cylindrical surface is formed in the lens in conjunction with the aspherical surface by additionally distorting the lens along the line extending parallel to said first side of the lens blank and passing through the axis of the lens blank by fixing the edge of the blank on said second side where said line crosses said edge and applying distorting pressure to said first side at points spaced radially from said axis and spaced circumferentially from the intersection of said line and said edge by about 90°. A spherical surface is formed in said second side providing a cylindrical surface component when the blank is released.

In a fourth embodiment in accordance with the invention, a twisting force is applied to the periphery of the blank to cause a first side to bulge, a spherical surface being formed in said first side to define an aspheric surface when said twisting distortion is released. A concave surface of the desired configuration may be formed in the second side of the blank before application of said twisting force and said blank may be grasped at said second side so as to retain the distortion. A convex spherical surface may then be formed in said first side, to thereby define a continuous bifocal lens.

Suitable tools are provided for producing the desired distortion in controlled, measurable amounts.

Still another object of the invention is to provide an apparatus for distorting lens blanks to permit the formation of aspheric surfaces therein.

A further object of the invention is to provide a apparatus for forming a contact lens having an aspheric concave surface.

Still a further object of the invention is to provide a apparatus for producing a lens having a continuous bifocal characteristic.

Another object of the invention is to provide a apparatus for forming a lens having an aspheric surface having a cylindrical component by forming a shpherical surface in a distorted lens blank.

Still other objects and advantages of the invention will in part by obvious and will in part be apparent from the specification and drawings.

The invention accordingly comprises the several steps and the relation of one or more of such steps with respect to each of the others, the apparatus embodying features of construction, combinations and arrangement of parts which are adapted to effect such steps, and the article which possesses the characteristics, properties and relation of elements, all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
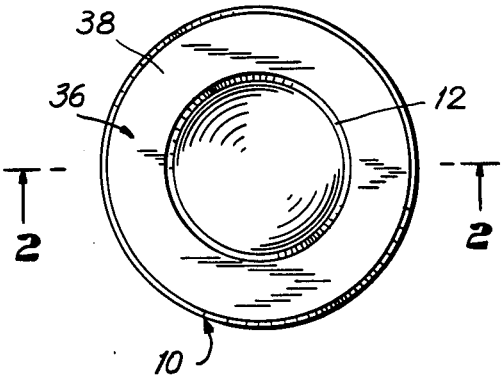
FIG. 1 is a top plan view of a first embodiment of a tool for forming lenses in accordance with the invention.
Figure 2:
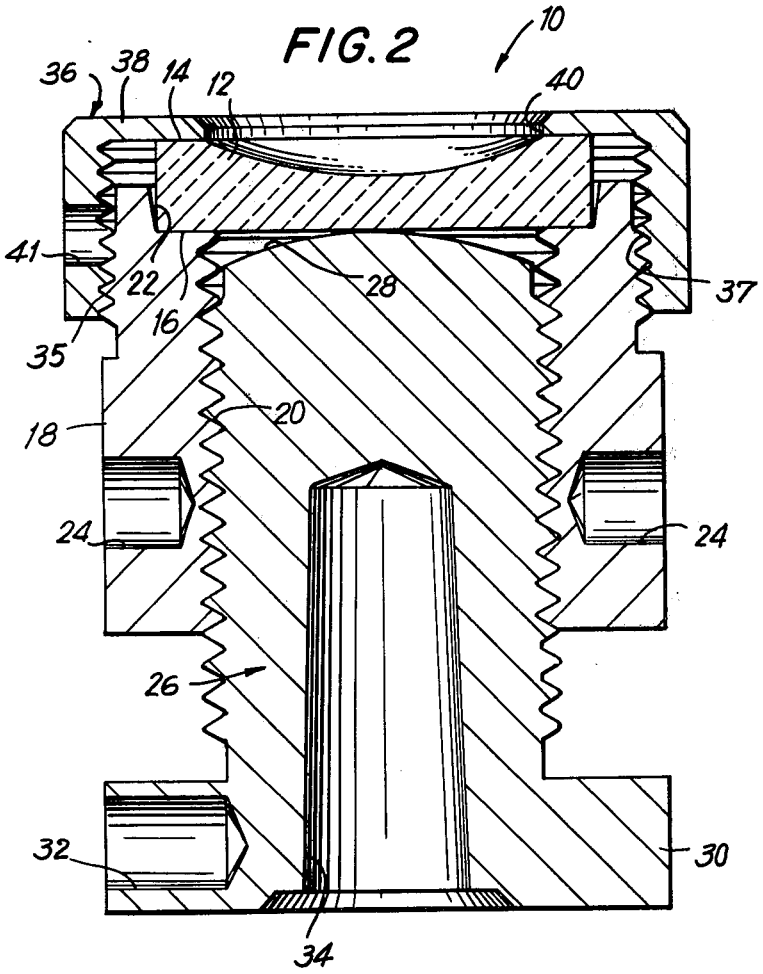
FIG. 2 is a sectional view taken along lines 2—2 of the tool of FIG. 1.
Figure 4:
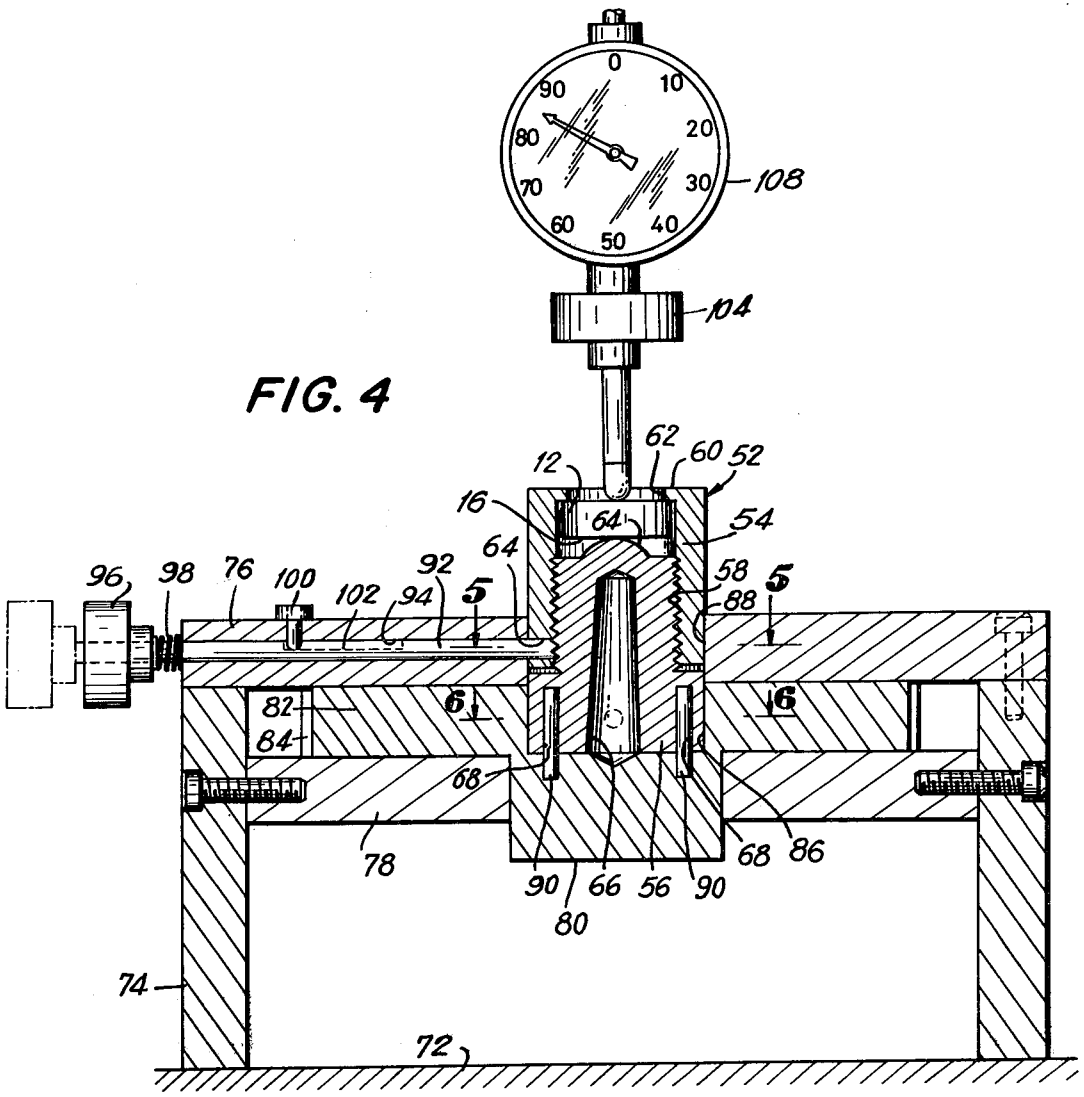
FIG. 4 is a sectional view taken along lines 4—4 of FIG. 3.
Figure 3:
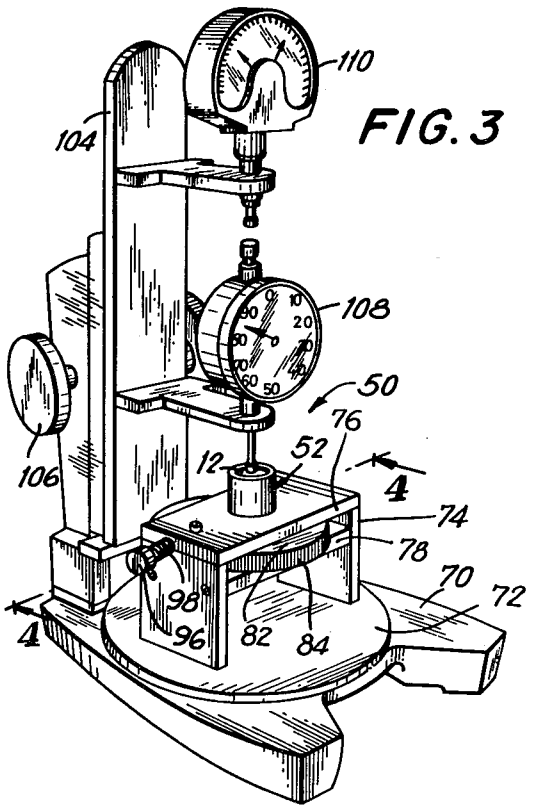
FIG. 3 is a perspective view of a jig for operating another embodiment of the tool in accordance with the invention and for measuring the results thereof.
Figure 5:
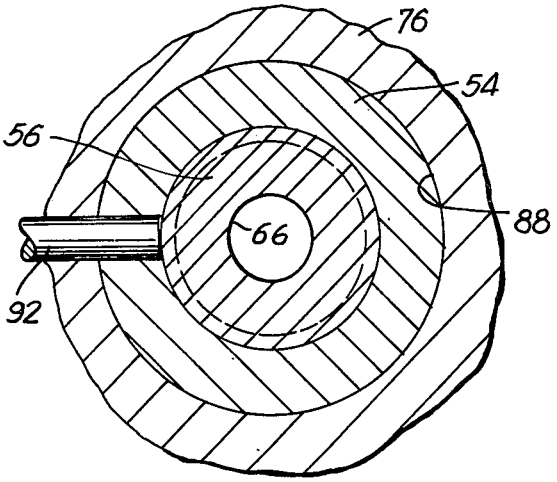
FIGS. 5 and 6 are sectional views taken along lines 5—5 and 6—6 of FIG. 4.

Referring now to FIGS. 1 and 2, a tool 10 for deforming lens blanks in accordance with the method of the invention is depicted. The blank 12 depicted in the drawings is of the type from which contact lenses are formed. The blank is disc-shaped and usually provided with parallel opposed sides 14 and 16 as illustrated in FIG. 7A. The tool consists of a cylindrical body portion 18 formed with a central threaded bore 20 terminating at one end in a region 22 of increased diameter defining a seat for receiving a lens blank 12. Said body portion is formed with a pair of recesses 24 on opposed sides of the outer wall thereof.

A threaded plunger portion 26 is received within threaded bore 20 of body portion 18 for displacement axially along the tool. Said plunger portion is provided with an arcuate front end 28 for engagement against side wall 16 of lens blank 12 substantially at the axis thereof. The rear end of plunger portion 26 is formed with a radially extending flange 30 having a radially extending recess 32 formed therein. Further, an axial recess 34 extends from the rear end of plunger portion 26 inwardly of said plunger portion.

Finally, said tool includes a cap portion 36 dimensioned to extend about the front end of body portion 18. Said front end of body portion 18 is provided with a peripherally threaded region 35 which mates with a correspondingly threaded inner surface 37 of cap portion 36. Said cap portion is provided with an end wall 38, which in turn is formed with a central aperture 40 to provide access to the central region of lens blank 12. End wall 38 bears against side wall 14 of lens blank 12 to retain said lens blank in seat 22.

An aperture 41 is formed in the threaded side wall of cap portion 36.

Lens blank 12 is formed of a flexible material, preferably a plastic such as an acrylic. The blank is mounted in seat 22 of body portion 18 with end cap 36 removed, and firmly positioned in said seat by mounting end cap 36 on to body portion 18. Aperture 41 and recesses 24 permit grasping of the end cap and body for relative rotation to insure the firm mounting of the lens blank in the tool. The blank is then distorted a predetermined distance by applying axial pressure to side wall 16 of the blank by rotating plunger 26. This rotation is achieved through the insertion of tools in recesses 24 and 32 to permit controlled relative rotation.

Figure 7:
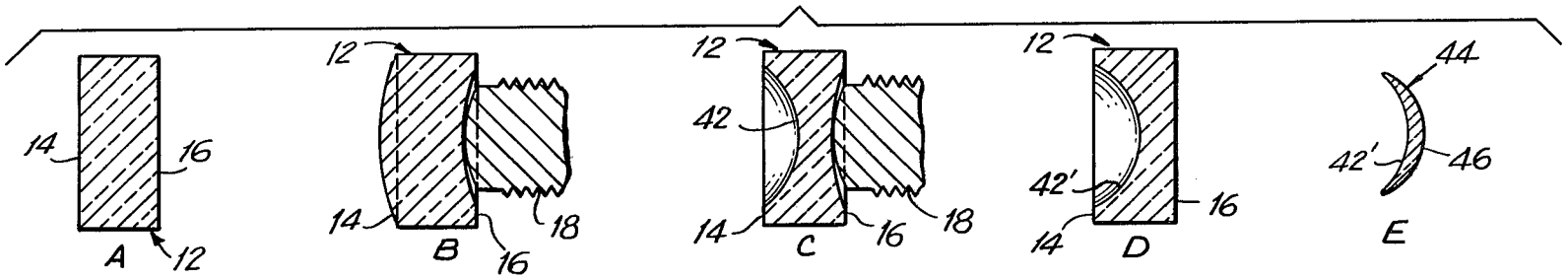
FIGS. 7 and 8 are sectional views of a lens blank at various stages of production illustrating two embodiments of the method in accordance with the invention.

Referring to FIG. 7, the method in accordance with the invention for producing one embodiment of the lens in accordance with the invention is depicted. The raw blank is depicted in FIG. 7A. The blank is distorted by plunger 18 as shown in FIG. 7B. While distorted, a spherical surface 42 is formed in side 14 by mounting the tool on a lathe and cutting the surface through aperture 40 in end cap 36. This step is depicted in FIG. 7C. The blank is released from the tool, relieving the distortion and changing the curvature of surface 42 to an aspherical surface 42' as illustrated in FIG. 7D. The surface 42 is polished in a conventional manner before release from the tool. The blank is then processed in a conventional manner to produce a contact lens 44 depicted in FIG. 7E. The contact lens would be characterized by an aspherical concave surface 42' and a spherical convex surface 46 selected to provide the desired correction. The embodiment of the method in accordance with the invention depicted in FIG. 7 produces an aspherical surface wherein the center region is steep relative to the periphery, so that the periphery is flatter than a comparable spherical surface.

In order to insure controlled distortion which will result in the production of an aspherical surface of the desired configuration, a mounting jig 50 illustrated in FIGS. 3–6 in conjunction with another embodiment of the tool in accordance with the invention is depicted. In this embodiment, the tool 52 is a two piece structure consisting of a body portion 54 and a plunger portion 56. The body portion is formed with a partially threaded bore 58 mating with a correspondingly threaded portion of plunger 56. Body portion 54 is formed integral with an end wall 60 which is formed with a central aperture 62 to provide access to lens blank 12. The front end of plunger 56 is provided with a ballshaped projection 64 which provides axial pressure on side wall 16 of lens blank 12 to effect distortion thereof. Body portion 54 is formed with a laterally extending aperture 64 in the side wall thereof, while the plunger is formed with a central tapered recess 66 and a pair of axially extending recesses 68 spaced radially from said central recess and extending longitudinally of plunger 56. The tool 52 functions in the same manner as tool 10 except that body portion 54 is removed from the plunger to permit insertion of lens blank 12.

Figure 6:
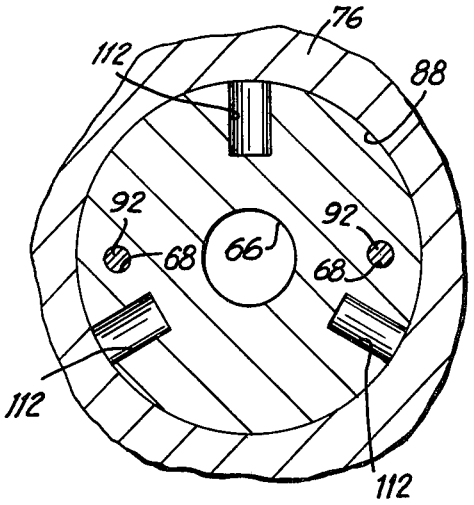

Mounting jig 50 includes a stand 70 supporting a tool holder 72. Said tool holder includes an upstanding frame 74 which includes a pair of spaced plates 76 and 78. Lower plate 78 is provided with a central aperture which supports the hub 80 of a knurled rotatable member 82 sandwiched between said plates. The periphery 84 of said rotatable member is knurled to permit displacement by the user. Said rotatable member is formed with a central well 86 in registration with a central aperture 88 in upper plate 76, both said well and aperture being dimensioned to receive the lower portion of tool 52. A pair of pins 90 project upwardly from the base of well 86 for receipt in recesses 68 in plunger 56. In this manner, the rotation of rotating member 82 carries with it the cartridge for relative displacement against body portion 54. Said body portion 54 is fixed relative to upper plate 76 by a pin 92 mounted in a radially extending bore 94 in upper plate 76. The pin is provided with a head 96 and biased in the position shown in solid lines by a coil spring 98, at which position the body portion 54 is fixed. The body portion is released by displacing pin 92 to the left as viewed in FIG. 4 as shown in chain lines. The displacement of said pin is limited by a set screw 100 which engages in a slot 102 in the surface of said pin. Stand 70 also carries a vertically displaceable micrometer holder 104, displacement being effected by rotation of knob 106 through a conventional rack and pinion arrangement (not shown). Micrometer holder 104 supports first micrometer 108 and second micrometer 110 in a different measuring configuration for precise measurement of the amount of distortion applied to the disc as measured by the displacement of the disc at the axis thereof. Thus, displacement of the disc is effected by displacement of plunger 56 by rotation of rotating member 82 by a controlled amount as read on the micrometers. As shown in FIG. 6, the body of tool 52 is also provided with radially extending recesses 112 for grasping by other tool types. It is also noted that measurement for the displacement due to distortion in the tool may also be effected by a radiuscope which optically measures the radius of curvature at various positions along the surface. If a radiuscope is to be utilized for measurement, a preliminary spherical surface would be cut in side wall 16 of the lens blank to permit measurement.

Figure 9:
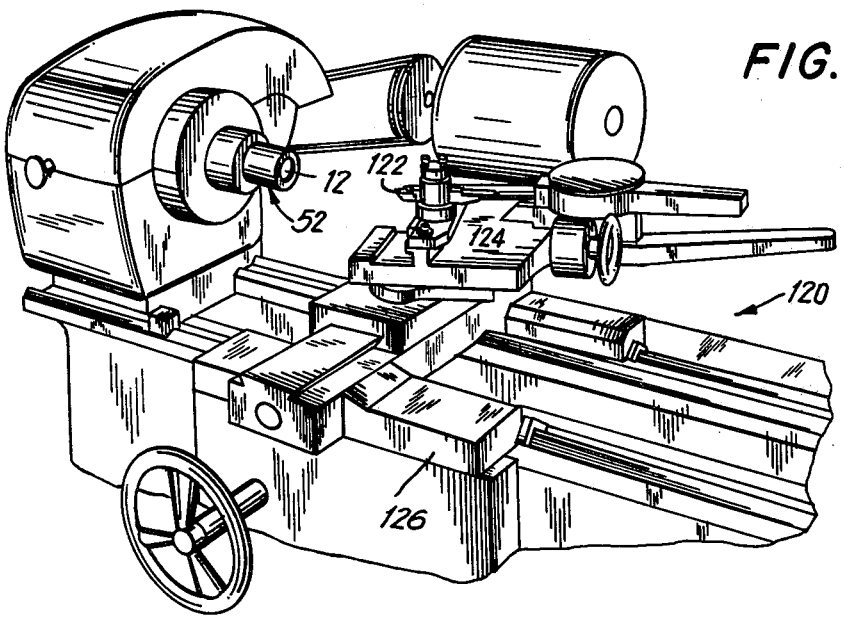
FIG. 9 is a fragmentary perspective view of a lathe for forming spherical surfaces in distorted lens blanks in accordance with the invention.

Referring to FIG. 9, a lathe 120 suitable for use in cutting spherical surfaces is depicted. The lathe is of essentially conventional construction, tool 52 being mounted on a mandril through tapered plug 66 for rotation. A cutting tool 122 is positionable to effect cutting of the lens blank 12 during rotation by the mandril, the cutting tool being pivotable along a predetermined axis to effect the cutting of a spherical surface. To this end, the cutting tool is mounted on a pivotably mounted tool holder 124, which is in turn mounted on a carriage 126 which permits positioning of the tool axially of the lens blank.

Figure 8:
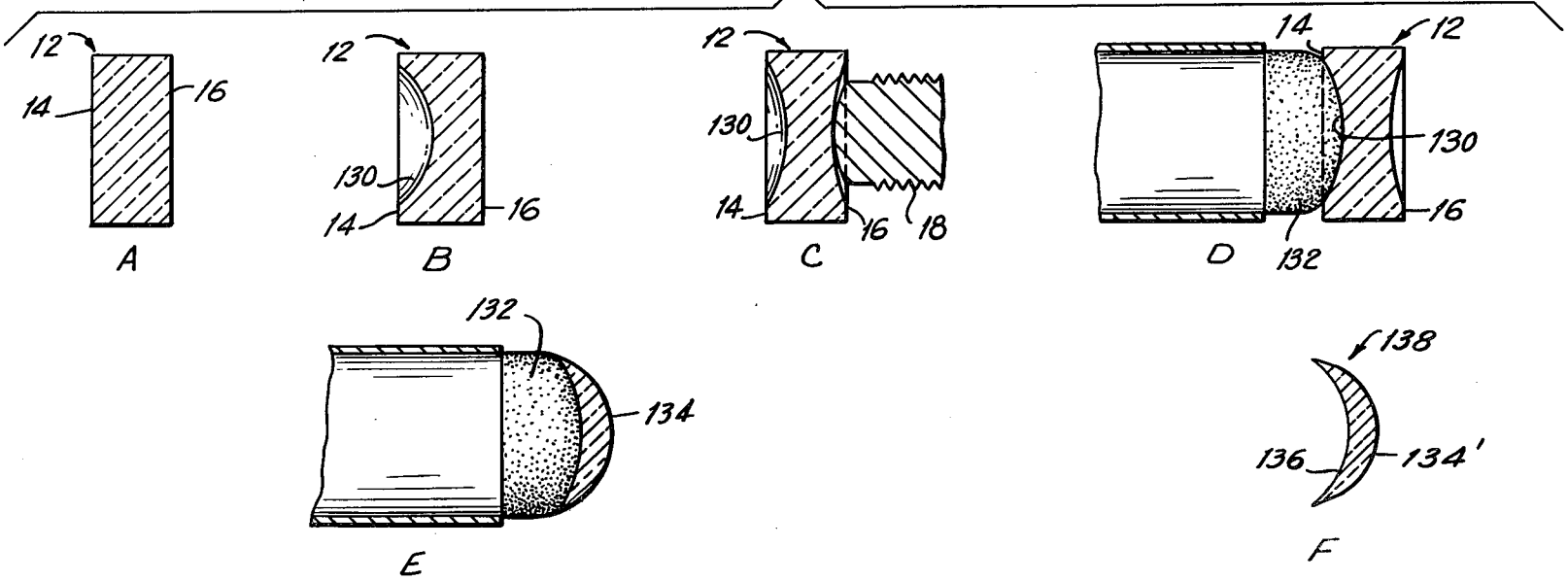
Figure 10:
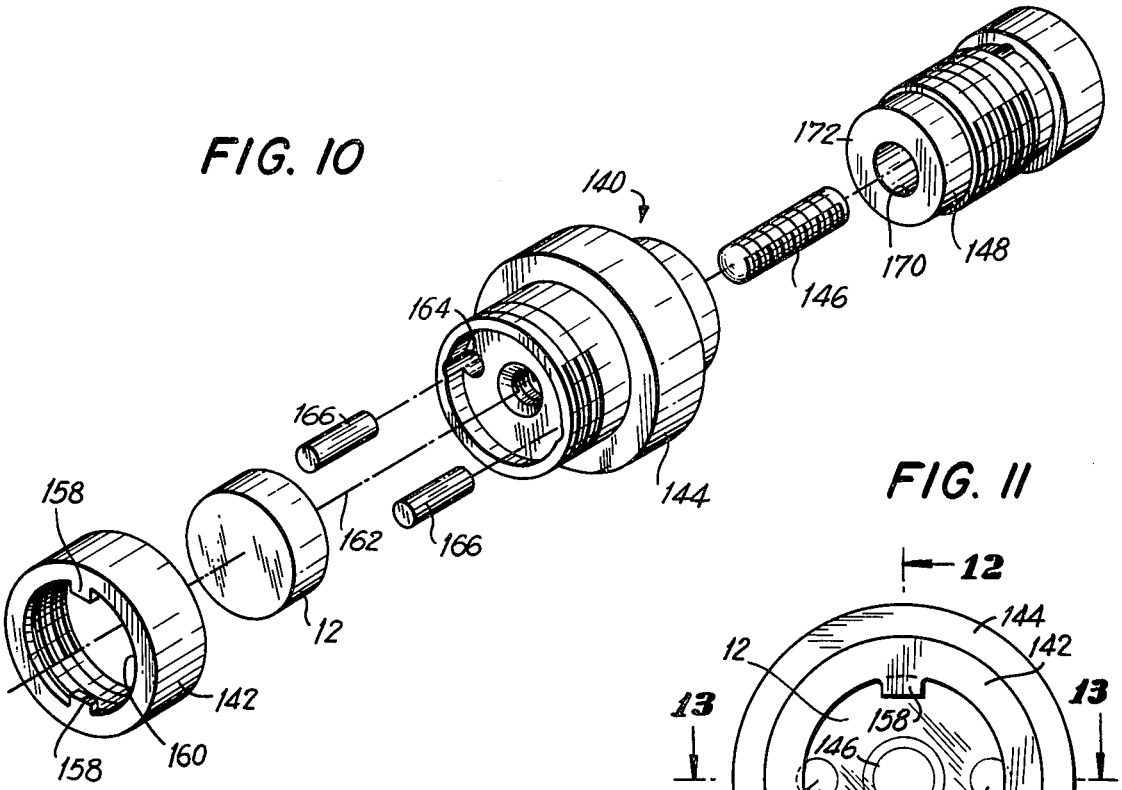
FIG. 10 is an exploded view of a second embodiment of the tool in accordance with the invention.
Figure 11:
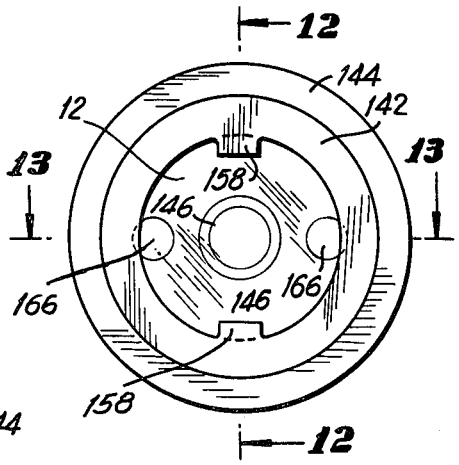
FIG. 11 is a top plan view of the assembled tool of FIG. 10.
Figure 12:
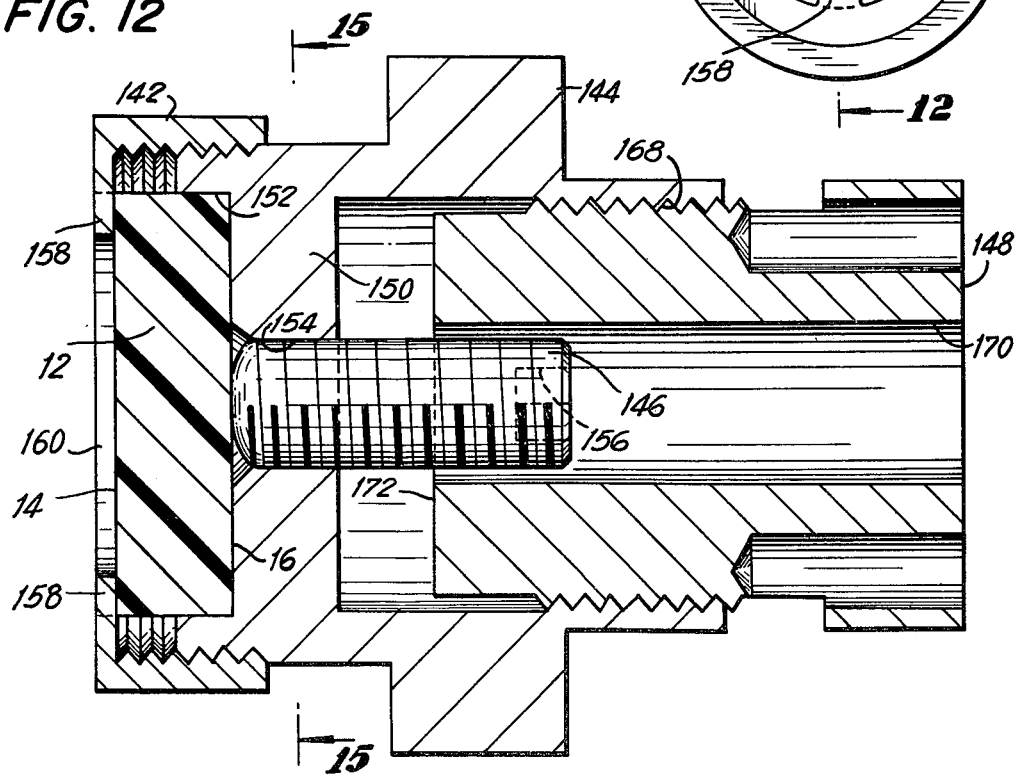
FIGS. 12 and 13 are sectional views taken along lines 12—12 and 13—13 respectively of FIG. 11.
Figure 13:
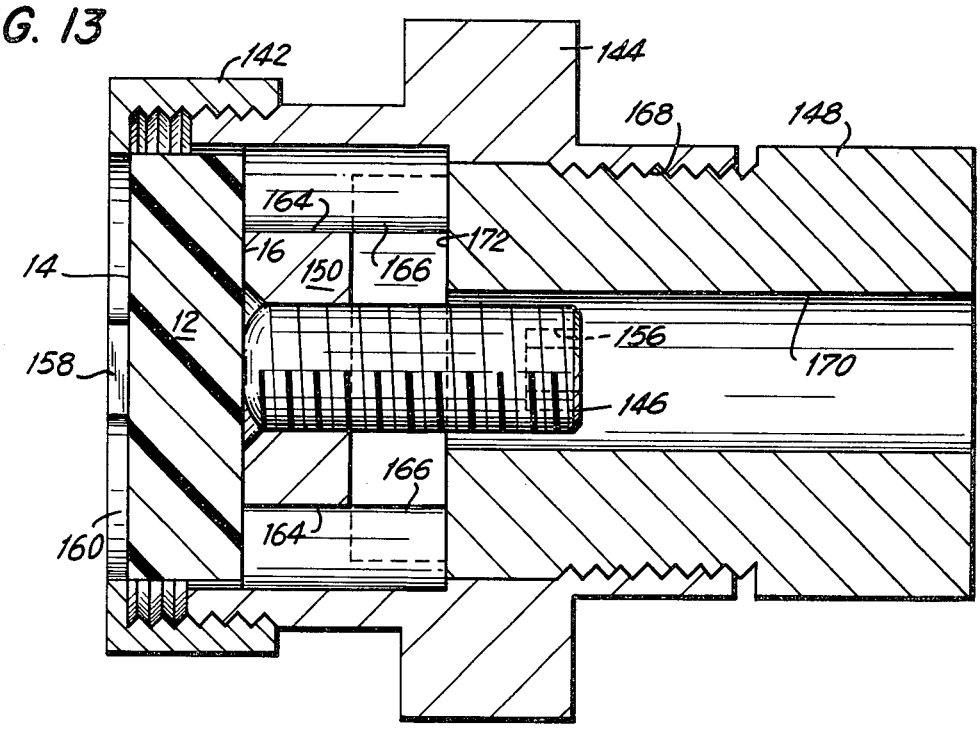
Figure 14:
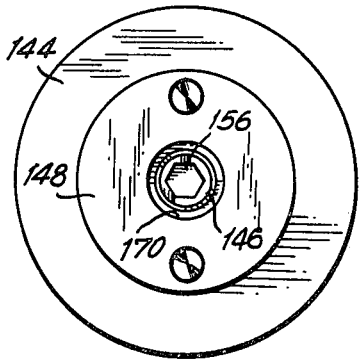
FIG. 14 is a bottom plan view of the tool of FIG. 10.
Figure 15:
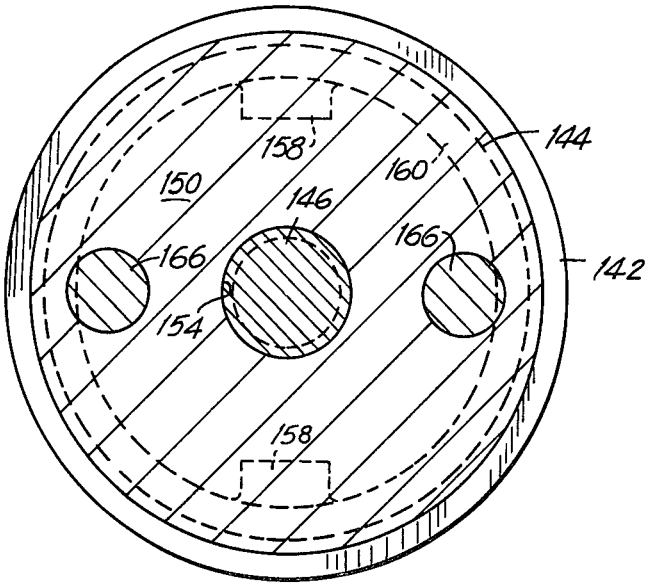
FIG. 15 is a sectional view taken along lines 15—15 of FIG. 12.

Referring now to FIG. 8, another embodiment of the method in accordance with the invention is depicted. In this embodiment, it is desired to cut an aspheric convex surface on side wall 16 of lens blank 12. As depicted in FIG. 8B, a spherical surface 130 is cut in side wall 14 in a conventional manner. The lens blank is distorted in the tool in accordance with the invention by displacing plunger 18 and engaging said plunger against side wall 16 at the axis thereof while fixing the periphery of the lens blank, as shown in FIG. 8C. While still in the tool, the distorted blank is fixed in the distorted configuration by engagement against a heated rod of pitch 132 as depicted in FIG. 8D. The heated end of said rod of pitch, when cooled, hardens and is capable of supporting and holding the distorted blank in the distorted position as illustrated in FIG. 8D. The pitch in question, also referred to as dental wax, may include Kerr's Red Compound and Burgundy Pitch manufactured by Edmund Scientific Corp. of Barrington, New Jersey. These substances are referred to by way of example, not by way of limitation, it being understood that any material capable of retaining the distorted blank in its distorted state may be utilized. The pitch rod is dimensioned so that the distorted blank may be removed from the tool and the assembly of pitch rod and distorted blank mounted on a mandril of a lathe such as the lathe of FIG. 9 for the formation of a spherical convex surface 134 on what was side wall 16, as depicted in FIG. 8E. The thus-modified lens blank is released from the pitch, releasing the distortion and changing the curvature of the spherical convex surface 134 to an aspherical surface 134'. As shown in FIG. 8F, a contact lens is formed from the blank by conventional methods. In the embodiment of FIG. 8, the concave surface 136 of lens 138 is spherical.

The lens prepared by the method of FIG. 8 is steeper in the center than at the periphery as compared to a spherical surface. Unlike the case of the lens 44 of FIG. 7E, where the steeper center of the concave surface increases the plus effect at the periphery, the lens 138 has a lesser plus correction at the periphery. Lens 138 is useful in that it reduces blur circles and residual astigmatic errors (spherical aberations).

It is frequently desirable in lenses of the type herein described, to provide a cylindrical correction specifically adapted to correct astigmatic conditions. A tool 140 adapted for this purpose is depicted in FIGs. 10–15. This tool is provided with a cap portion 142, a body portion 144, an inner plunger 146 and an outer plunger 148. The body portion is provided with a lateral wall 150 which defines a seat 152 for receiving lens blank 12. A central threaded aperture 154 is formed in said wall for receiving threaded inner plunger 146. Said plunger is formed with a hexagonal recess 156 (FIG. 14) to permit axial displacement of the inner plunger to effect distortion of the lens blank as described above. The lens blank is retained in well 152 by threaded cap member 142, which differs from the cap member 36 of tool 10 in that, in place of an end wall, the cap member is provided with a pair of opposed projections 158 extending radially inwardly from the periphery of the aperture 160 in the outer end of cap member 142. In effect, projections 158 support and fix the periphery of the lens blank along the line parallel to side wall 14 of lens blank 12 passing through the axis 162 of the lens blank. As more particularly shown in FIGS. 13 and 15, lateral wall 150 of body portion 144 is provided with a pair of bores 164 extending parallel to axis 162 but radially spaced therefrom. Said bores are positioned on a line extending parallel to side wall 16 of lens blank 12 passing through axis 162 and extending perpendicularly to the line defined by projections 158 when end cap 142 is mounted on body portion 144 with a lens blank in position. A pair of pins 166 ride in apertures 164 for engagement against the periphery of side wall 16 of lens blank 12. Outer plunger 148 is threadably received in an axial bore 168 extending from the rear of body member 144 to lateral wall 150. Said outer plunger is provided with an axial bore 170 which permits clearance for inner plunger 146. The inner end 172 of outer plunger 148 engages against pins 166 to apply a cylindrical distortion to blank 12. Thus, blank 12 may be subjected to a compound distortion having cylindrical and axial components caused by the composite action of pins 166 and inner plunger 146. A spherical surface would be formed in side wall 14 of the distorted blank in the manner described above so as to define an aspheric surface having a cylindrical correction when the blank is released. The lens thus produced is capable of correcting astigmatic errors.

Figure 16:
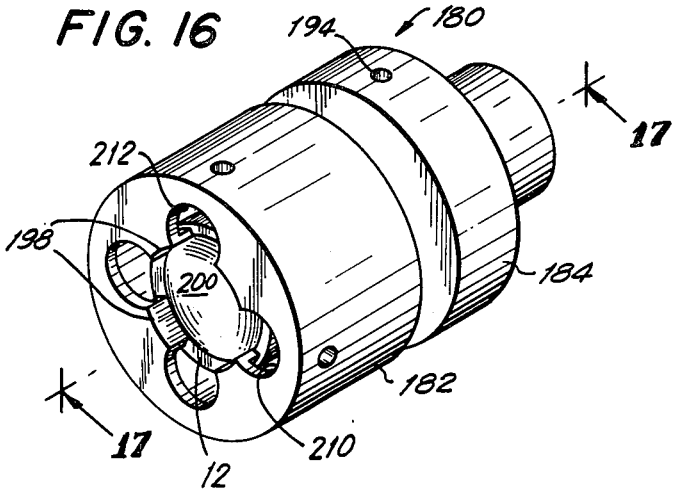
FIG. 16 is a perspective view of a third embodiment of the tool in accordance with the invention.
Figure 17:
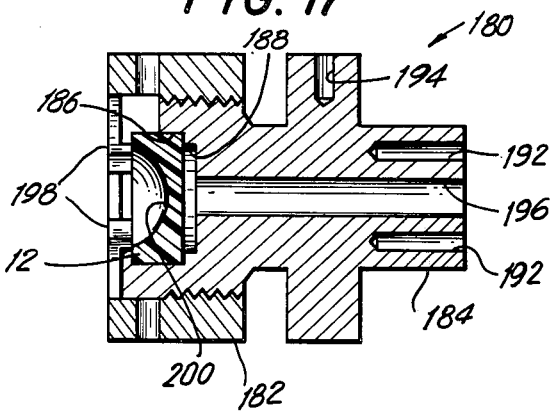
FIG. 17 is a sectional view taken along lines 17—17 of FIG. 16.
Figure 18:
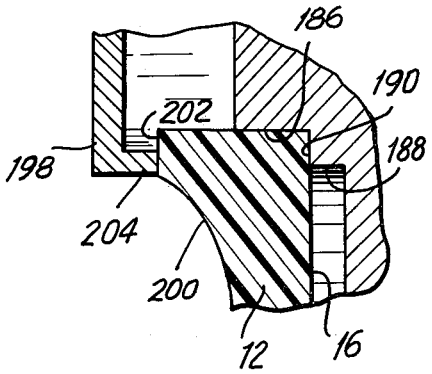
FIG. 18 is an exploded fragmentary view of a portion of the tool of FIG. 16.

Turning now to FIGS. 16 – 18, still another tool for applying still another type of distortion to a lens blank is depicted. Tool 180 includes a cap member 182 and a plunger member 184. The plunger member is formed with a stepped seat 186 for receiving lens blank 12. The stepped seat is provided with a chamber 188 of reduced diameter to permit distortion of the lens blank so that the lens blank is supported at its periphery by rim 190 of seat 186. Plunger member 184 is provided with axially extending recesses 192 and radially extending recesses 194 for manipulation thereof. The plunger is also provided with a relatively narrow axial bore 196 providing communication to chamber 188. The front end of plunger 184 is threadably coupled to end cap 182, which end cap is provided with a segmented end wall defined by four projections 198. As shown in FIGS. 16 – 18, lens blank 12 has a spherical surface formed in the central region of side wall 14 thereof leaving a flat periphery 202. As is more particularly shown in FIG.

Figure 21:
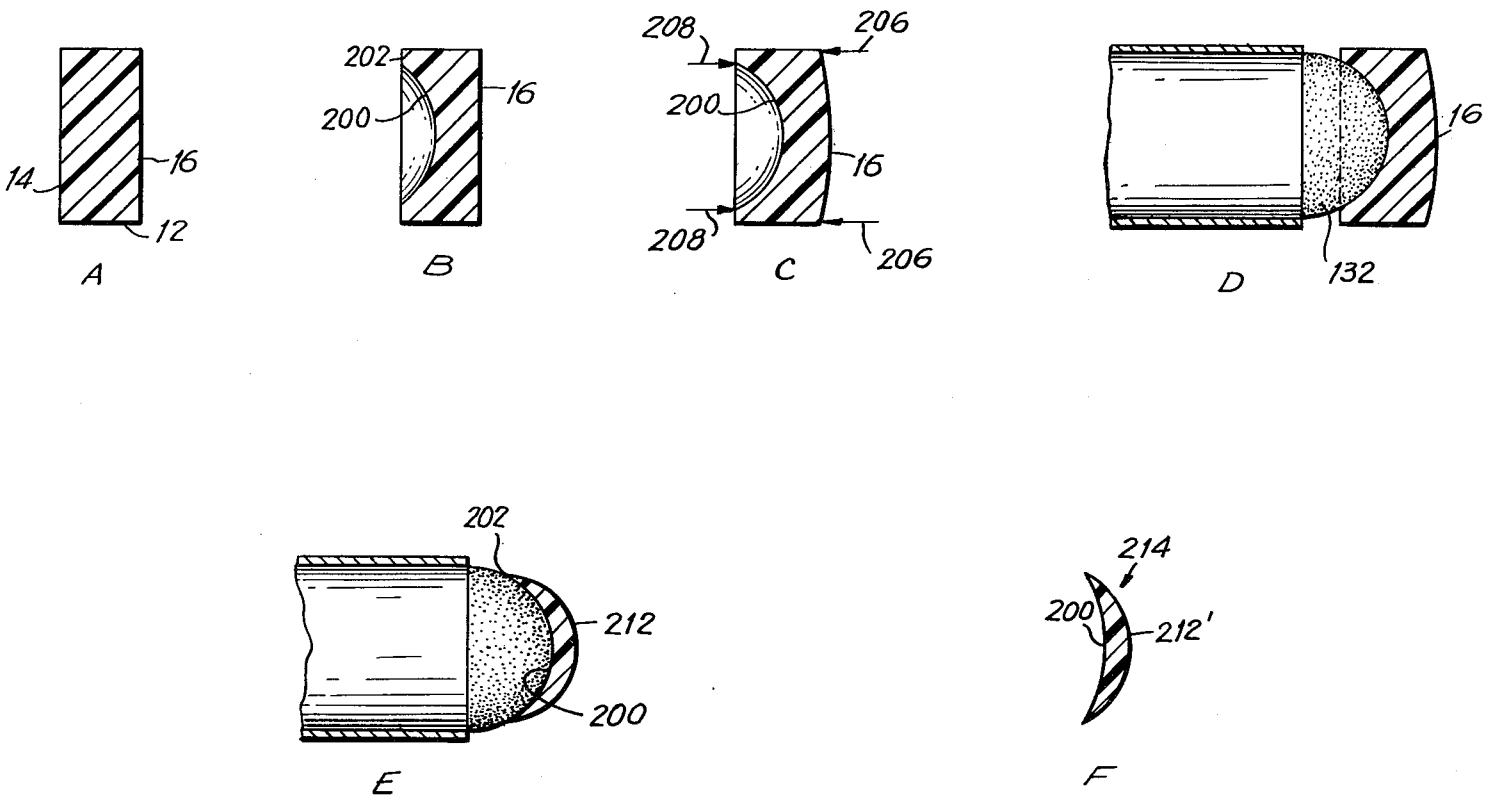
FIG. 21 A-F is sectional views of a lens blank in various stages of construction illustrating still another embodiment of the method in accordance with the invention.

18, each of projection 198 is formed with an axial finger 204 which extends toward peripheral surface 202 and engages said peripheral surface inwardly of the outer edge thereof. Also as more particularly shown in FIG. 18, projections 198 are preferably dimensioned so that fingers 204 do not overlap rim 190. When plunger 184 is displaced relative to end cap 182 a twisting distortion is applied to lens blank 12 due to the pressure applied by finger 204 inwardly of the outer periphery of surface 202 and rim 190 at the periphery of side wall 16. Referring now to FIG. 21, FIG. 21A depicts the raw blank. FIG. 21B depicts the blank with the spherical surface 200 formed therein to further define the flat peripheral surface 202. FIG. 21C depicts the distortion with the arrows 206 representing the force applied by rim 190 and the arrows 208 representing the force applied by fingers 204. As shown in FIG. 21D, the distorted blank is fixed in the distorted position by a pitch rod 132 as described above. The circular cutouts 210 defining projections 198 are provided to permit the pitch to engage the flat surface 202 to insure retention of the distortion. As shown in FIG. 21E, a convex spherical surface 212 is formed on side wall 16 of the distorted lens blank, which, upon release, defines an aspherical surface 212'. Said aspherical surface is depicted in the finished lens 214 of FIG. 21F. The concave surface 200 can be spherical or aspherical as desired. Lens 214 is characterized by the periphery of the convex surface being steeper than the center region as compared to a spherical curve. This effect adds a plus correction to the periphery to create a lens having a bifocal effect. In effect, the correction at the periphery is greater than the correction at the center, so that, for example, the periphery may be used for reading and the center for distance viewing. In this manner, a continuous bifocal effect is produced in the lens by the arrangement in accordance with the invention.

Figure 19:
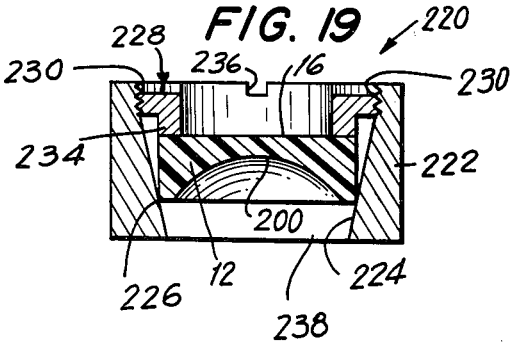
FIG. 19 is a sectional view of a fourth embodiment of a tool in accordance with the invention.
Figure 20:
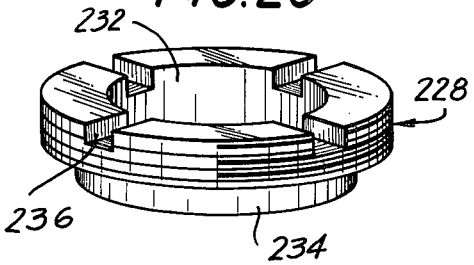
FIG. 20 is a perspective view of the adjusting ring of the tool of FIG. 19.

Still another tool for producing the twisted distortion of FIG. 21 is depicted in FIGS. 19 and 20. Tool 220 is provided with a body member 222 formed with a tapered central bore 224 which receives a blank 12 having a surface 200 formed therein. The peripheral edge 226 of side wall 14 in which surface 200 is formed engages against the tapered bore 224. A pressure ring 228 having a threaded periphery engages a threaded portion 230 at the wider end of tapered bore 224. Ring 228 is provided with a central aperture 232 to permit distortion of the lens and a circumferential hub 234 for engaging against side wall 16 of lens blank 12 to drive the lens blank into the tapered bore 224. Ring 228 is also provided with notches 236 for receipt of a tool for the rotation of the ring. The distorted blank is fixed by a pitch rod passed through opening 238 in tapered bore 224, the narrower end of said tapered bore.

Figure 22:
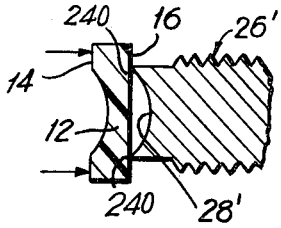
FIG. 22 is a fragmentary section view of a fifth embodiment of a tool in accordance with the invention.

A further tool for producing the twisted distortion of FIG. 21 is partially depicted in FIG. 22. The plunger 26' would be used in a tool such as tools 10 and 52 for engagement against the flat surface 16 of a lens blank 12. In place of ball-shaped projection 28 or 64, plunger 26' is provided with a concave end surface 28' defining a ring-shaped projection 240. The twisting force results from the combination of the pressure of ring-shaped projection 240 on side 16 of the lens blank and the pressure of end wall 38 or 60 of cap member 36 or 54.

The method of FIG. 21 offers further advantages resulting from the greater index of refraction of tears as compared to air. Thus, the index of refraction of air is 1, the index of refraction of tears is 1.33, while the index of refraction of one button utilized in this invention is 1.49. Because the focal power of the air to lens interface is about three times the focal power of the lens to tear interface, one-third less correction of the convex outer surface of the lens is required to achieve the same result as a correction on the concave inner surface.

While the foregoing embodiments are illustrated through the manufacture of contact lenses, the method and apparatus in accordance with the invention are not limited to the manufacture of contact lenses, and are equally applicable to the manufacture of other optical lenses, including conventional eye glass lenses.

It will thus be seen that the objects set forth above, among those made apparent from the preceding description, are efficiently attained, and since certain changes may be made in carrying out the above process, in the described product, and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A tool for forming a lens from a lens blank having an axial region and a periphery, comprising means for holding said lens while providing access to the opposed sides thereof passing through the axis of said lens blank and means for applying distorting force along said axis to one of said sides of said lens blank for axially displacing the axial region of said blank relative to all points on the periphery of the blank, said holding and distorting means including a body member having an axial bore therethrough terminating in an end wall formed with an axial aperture therethrough, said end wall defining a seat for receipt of said blank within said bore, a plunger dimensioned for receipt within said bore for applying said distorting force, thread means on the bore of said body and said plunger member for application of said distorting force upon the rotational displacement of said plunger member, jig means for fixedly supporting said body member and including a rotatable member for engaging said plunger member for selective rotation thereof, and means for measuring the displacement of the axial region of said lens blank in response to said distorting force, said measuring means including micrometer means having a displaceable plunger for effecting measurement and means supporting said micrometer means with said plunger axially aligned with respect to said axial bore of said body member and positioned for engagement against said lens blank.

2. The tool as recited in claim 1, wherein said body member includes a tubular member formed with said axial bore terminating in a region of increased diameter defining a seat for said lens blank and a cap member releasably engaging said tubular member for retaining said lens blank within said seat, said cap member defining said end wall and being formed with an axial aperture therethrough to expose said lens blank.

3. The tool as recited in claim 1, including further means for applying distorting force at at least a pair of points adjacent to the periphery of said lens blank, said points lying in a first line passing through the axis of said lens blank, said means for retaining said lens blank fixing said lens blank at the periphery thereof at points lying in a second line extending normally to said first line and passing through said lens blank axis, whereby a cylindrical distortion is applied to said lens blank, said body member including a tubular member having a transverse wall defining a seat for receiving said lens blank, said transverse wall being formed with a central axial aperture and a pair of further apertures radially spaced from said axis in registration with said points on said first line, a cap member releasably engaging said tubular member and defining said end wall to retain said lens blank in said seat, said cap member being formed with a pair of inwardly extending projections engaging and retaining said lens blank, said projections being aligned along said second line; said plunger means including inner plunger means mounted for axial displacement in said central aperture of the transverse wall of said body member for applying distorting force, said body member further including a pair of pin means, one of said pin means being positioned in each of the further apertures lying on said first line, and an outer plunger axially displaceable in the bore of said body member for engaging said pin means for applying said further distorting force.

4. The tool as recited in claim 1, wherein said plunger member is formed with a convexly curved end surface for engaging said lens blank substantially at the axis thereof to apply said distorting pressure.

5. The tool as recited in claim 1, wherein said plunger member is formed with a concavely curved end surface defining an essentially ring-shaped projection for engaging said blank substantially concentrically with said axis to apply said distorting pressure.

6. A tool for forming a lens from a lens blank having an axial region and a periphery, comprising means for holding said lens while providing access to the opposed sides thereof passing through the axis of said lens blank, means for applying distorting force along said axis to one of said sides of said lens blank for displacing the axial region of said blank relative to all points on the periphery of the blank and further means for applying distorting force at at least a pair of points adjacent the periphery of said lens blank, said points lying in a first line passing through the axis of said lens blank, said means for holding said lens blank fixing said lens blank at the periphery thereof at points lying on a second line extending normally to said first line and passing through said lens blank axis, whereby a cylindrical distortion is applied to said lens blank in addition to said displacement of the axial region of said lens blank.

7. The tool as recited in claim 6, including a body member having a transverse wall defining a seat for receiving said lens blank, said transverse wall being formed with a central axial aperture and a pair of further apertures radially spaced from said axis in registration with said points on said first line; a cap member releasably engaging said body member to retain said lens blank in said seat, said cap member being formed with a pair of inwardly extending projections engaging and retaining said lens blank, said projections being aligned along said second line; inner plunger means mounted for axial displacement in said central aperture of the transverse wall of said body member for applying distorting force; a pair of pin means, one of said pin means being positioned in each of the further apertures lying on said first line; and an outer plunger axially displaceable in the bore of said body member for engaging said pin means for applying said further distorting force.

8. A tool for forming a lens from a lens blank having an axial region and a periphery, comprising means for holding said lens while providing access to the opposed sides thereof passing through the axis of said lens blank and means for applying distorting force along said axis to one of said sides of said lens blank for displacing the axial region of said lens blank relative to all points on the periphery of the blank, said holding and distorting means including a plunger member formed with a recess at one end thereof dimensioned to receive said lens blank and a chamber adjacent said recess defining a rim with said recess for engaging the periphery of said lens blank, and a cap member formed with an axial bore terminating in a plurality of radially inwardly extending projections terminating at a point spaced from the axis of said plunger member, each of said projections being formed with an axially extending finger projecting into the axial bore of said cap member, at least a portion of said fingers being radially spaced a lesser distance from the axis of said plunger member and lens blank than said rim defined by said seat and chamber of said plunger member, said cap member threadably engaging said plunger member for relative displacement to apply said distorting force.

9. A tool for forming a lens from a lens blank having an axial region and a periphery, comprising means for holding said lens while providing access to the opposed sides thereof passing through the axis of said lens blank and means for applying distorting force along said axis to one of said sides of said lens blank for displacing the axial region of said lens blank relative to all points on the periphery of the blank, said holding and distorting means including a body member formed with a tapered axial bore dimensioned to receive said lens blank so that the peripheral edge of said lens blank engages and rides on a portion of the tapered surface of said bore, and including means for displacing said lens blank into said tapered bore toward the end of lesser diameter to apply a twisting distortion to said lens blank relative to the tapered bore to effect said displacement of the axial region of said lens blank.

10. The tool as recited in claim 9, wherein said displacing means includes ring means threaded at the periphery thereof, said tapered bore terminating in a threaded region at the end thereof of greater diameter for cooperative engagement with said ring means, said ring means engaging and driving said lens blank into said tapered bore.

* * * * *